United States Patent [19]

Varona

[11] 4,419,403

[45] Dec. 6, 1983

[54] WATER DISPERSIBLE PREMOISTENED WIPER

[75] Inventor: Eugenio Varona, Wilmington, Del.

[73] Assignee: Scott Paper Company, Philadelphia, Pa.

[21] Appl. No.: 328,305

[22] Filed: Dec. 7, 1981

[51] Int. Cl.[3] ..... A61F 13/16; D04H 1/58; B32B 27/00

[52] U.S. Cl. ..... 428/288; 428/290; 604/364; 604/374

[58] Field of Search ..... 428/288, 289, 290, 245, 428/247, 198; 128/284, 290 R, 290 W

[56] References Cited

U.S. PATENT DOCUMENTS

| | | | |
|---|---|---|---|
| 3,624,069 | 11/1971 | Schwelger | 260/210 |
| 3,939,836 | 2/1976 | Tunc | 128/290 R |
| 3,965,518 | 6/1976 | Muoio | 428/289 |
| 4,200,557 | 4/1980 | Chatterjee et al. | 128/284 |

*Primary Examiner*—George F. Lesmes
*Assistant Examiner*—Beverly K. Johnson
*Attorney, Agent, or Firm*—John A. Weygandt; John W. Kane, Jr.

[57] ABSTRACT

Premoistened wipers are provided with wet strength through the use of colloidal sulfate esters of cellulose having a high degree of sulfate substitution, equal to or greater than 2.5. When such wipers are immersed in water, they become easily dispersible and hence flushable.

6 Claims, No Drawings

WATER DISPERSIBLE PREMOISTENED WIPER

BACKGROUND OF THE INVENTION

1. Field of the Invention

This invention relates to premoistened wipers which are readily dispersible in water and are flushable. Particularly, this invention relates to premoistened wipes for use in cleansing the human body which after use are capable of being disposed of in conventional domestic plumbing systems.

2. Description of the Prior Art

The use of cellulose sulfate as a binder for nonwoven fabrics which are readily dispersible in water and are flushable is known. U.S. Pat. No. 3,939,836 granted Feb. 24, 1976 to D. C. Tunc describes an alkali salt of a sulfated cellulose ester resin which gives good dry tensile strength to fabrics, which strength is retained in significant part when such fabrics are contacted with a salt solution typical of body fluids such as blood, menstrual fluid or urine and yet are readily dispersible in water. The resins disclosed in said patent have a degree of sulfate substitution of from 0.10 to 0.45. According to the teachings of U.S. Pat. No. 3,939,836, the resistance of the nonwoven fabrics to such solutions increases greatly with decreasing sulfate substitution.

SUMMARY OF THE INVENTION

The premoistened wipers of the present invention are provided with wet strength through the use of colloidal sulfate esters of cellulose but, contrary to the teachings of said prior art U.S. Pat. No. 3,939,836, these esters have a degree of substitution equal to or greater than 2.5. Degree of sulfate substitution expresses the average number of sulfate groups per anhydroglucose unit of the cellulosic ester. The cellulose sulfates suitable for use in the present invention are described in U.S. Pat. No. 3,624,069 granted Nov. 30, 1971 and assigned to the Kelco Company, said patent disclosure being incorporated herein by reference. These sulfate esters of cellulose form aqueous gels in the presence of potassium ions.

When such wipers are immersed in water, for example, the water in a toilet, the gel is broken and the wiper becomes easily dispersible and hence flushable in any home plumbing and capable of disposal in standard sewer systems or septic tanks. When an article is referred to herein as being flushable it is meant that that article may be deposited in and flushed through a conventional domestic toilet without any undue clogging of the toilet or the plumbing. When such an article is referred to herein as being water dispersible, it is meant that that article when placed in water breaks up and is flushable. The wipers of the present invention are intended for use as premoistened bathroom tissue, facial tissue, comestic wipes, baby wipes and other applications for cleansing or treating the human skin.

DESCRIPTION OF THE PREFERRED EMBODIMENTS

A fibrous web suitable for conversion into the wipers of the present invention may be formed by carding, air deposition, water deposition or any of the other various techniques known in the art for forming nonwoven webs. As will be appreciated the web itself is fashioned in such a way that it will disperse satisfactorily in water when it is no longer wet strengthened by the gelled cellulose sulfate.

The cellulose sulfates for use in the present invention are such that an aqueous solution will form a gel when potassium ions are added thereto. In addition they have a degree of substitution equal to or greater than 2.5. As pointed out by the inventor in U.S. Pat. No. 3,624,069 while other cations such as ammonium will form gels with the cellulose sulfates made in accordance with his invention, potassium ions are preferable for this purpose. Inasmuch as the wipers of the present invention are intended for use on the human skin, ammonia would be unsuitable and obviously the source of the potassium ions should be a non-irritating one such as potassium citrate or potassium chloride. As stated in said patent at column 5, lines 62–68 the strength of the gel depends on the degree of substitution, on the viscosity and on the concentration of cellulosic sulfate and potassium ions. It is desirable that the potassium ion be present in an amount in excess of 9 milli equivalents per 100 cc. of aqueous solution containing sufficient cellulose sulfate to form a gel, for example 1% by weight.

In accordance with the present invention, the fibrous cellulosic web is impregnated with an alkali salt of a sulfated cellulose ester and dried. The web is thereafter treated with a solution of potassium ions, for example, a solution of potassium citrate at a concentration of 3 to 5 percent by weight. As long as the polymer impregnated web remains wet with the salt solution it is provided with wet-strength by the cellulose sulfate. However, when the web is placed in a quantity of water, the wet strength disappears rapidly and irreversibly and the web disperses into small flushable pieces. The cellulose sulfate can be applied to the web by any conventional technique either overall, as by saturation, or selectively, as by print bonding. The salt solution may, in addition, contain components such as fragrance, surfactants, humectants or any other components which do not influence the action of the potassium ion on the cellulose sulfate.

For easier processability it is preferred to add the potassium ions to the binder solution before the binder is added to the web because the potassium ions depress (lower) the vicosity of the binder solution. More importantly, this order of addition also reduces the amount of potassium needed in the lotion and improves the heat stability of the product. For a web having 3% by weight addition of binder, application of a 0.1 molar potassium ion solution is sufficient to preserve wet tensile at room temperature (75° F.). Application of a 0.4 molar potassium ion solution is needed for the aforementioned web to preserve wet tensile for aging at 145° F. for six (6) days. For potassium citrate this corresponds to about a 5% solution.

The amount of sulfated cellulose ester binder distributed in the nonwoven web should be greater than 1% (one percent) by weight of the web. If less than about 1% is employed, the fabric does not have sufficient wet strength to be useful for wiping. As a practical matter, sufficient wet tensile strength is developed in the range of 2–20% addition of binder by weight of the web. The amount to be added is a matter of choice dependent upon the level of strength desired and the inherent strength of the fibrous cellulosic web before addition of binder. The level of binder addition can be a matter of choice because dispersibility does not decline markedly with increasing binder addition. In order to better illustrate the invention, the following examples are given:

A binder solution of sodium cellulose sulfate was prepared by dissolving the resin in water to yield a solution containing 3% (three percent) by weight resin solids. The resin was one commercially designated as "high viscosity". Swatches of a fibrous web consisting of a paper web of 24 pounds per ream of 3300 sq. ft. were treated with the above solution by immersion in the above-indicated binder solution and drying at 105° C. for 3 to 5 minutes, or until dry. The weight percentages of binder addition to in the resulting nonwoven fabric ("add-on") are given in Tables 1 and 2. The resulting swatches identified as A, B and C in Table 1 and A', B' and C' in Table 2 were tested for their for tensile strength properties after immersion in water immediately after treatment, after five days of ambient aging in the case of A, B and C and after six days at elevated temperature in the case of A', B' and C'. In each of the foregoing six cases, after drying, the web was saturated (at least 100% by weight absorption) with a solution of 5% (five percent) potassium citrate. The control D consisted of the identical paper web without the addition of any cellulose sulfate or potassium ions. In the Table "MDWT" stands for "machine direction wet tensile" and is expressed in ounces per inch, and dispersibility is expressed in seconds.

TABLE 1

| | | Initial | | After 5 days at 75° F. | |
|---|---|---|---|---|---|
| | % Add-on | MDWT | Dispersibility | MDWT | Dispersibility |
| A | 3 | 11 | 55 | 11 | 65 |
| B | 7 | 24 | 88 | 28 | 90 |
| C | 11 | 39 | 90 | 34 | 95 |

TABLE 1-continued

| | | Initial | | After 5 days at 75° F. | |
|---|---|---|---|---|---|
| | % Add-on | MDWT | Dispersibility | MDWT | Dispersibility |
| D | 0 | 2 | 65 | 2 | 65 |

TABLE 2

| | | Initial | | After 6 days at 145° F. | |
|---|---|---|---|---|---|
| | % Add-on | MDWT | Dispersibility | MDWT | Dispersibility |
| A | 3 | 13 | 70 | 10 | 60 |
| B | 5 | 22 | 80 | 18 | 82 |
| C | 7 | 30 | 85 | 25 | 90 |
| D | 0 | 2 | 60 | 2 | 60 |

What is claimed is:

1. A water dispersible premoistened wiper comprising a nonwoven cellulosic fibrous web containing greater than 1% by weight of an alkali salt of a sulfated cellulose ester resin binder distributed in said fibrous web, said resin binder having a degree of saturation of about 2.5 to 3.0 sulfate groups per anhydrogluclose unit, and said web being impregnated with an aqueous solution of potassium ions in an amount effective to gel said sulfated cellulose ester resin binder.

2. The wiper according to claim 1 wherein the potassium ion concentration in said solution is at least 0.1 molar.

3. The wiper according to claim 1 wherein said aqueous solution of potassium ions is at least 0.4 molar.

4. The wiper according to claim 1 wherein said potassium ions are provided by potassium citrate.

5. The wiper according to claim 1 wherein said potassium ions are provided by potassium chloride.

6. The wiper according to claim 1 wherein said sulfated cellulose ester resin binder is distributed in an amount equal to 2–20% by weight of the web.

* * * * *